US006384740B1

(12) United States Patent
Al-Ahmed

(10) Patent No.: US 6,384,740 B1
(45) Date of Patent: May 7, 2002

(54) TRAFFIC SPEED SURVEILLANCE AND CONTROL SYSTEM

(76) Inventor: Khaled A. Al-Ahmed, Al-Riqqa, Block 7, 4th St., House #(1) - 218, Ahmadi (KW)

( * ) Notice: Subject to any disclaimer, the term of this patent is extended or adjusted under 35 U.S.C. 154(b) by 0 days.

(21) Appl. No.: 09/916,311

(22) Filed: Jul. 30, 2001

(51) Int. Cl.[7] ..... G08G 1/01

(52) U.S. Cl. ..... 340/936; 340/466; 340/905; 340/539; 701/119

(58) Field of Search ..... 340/936, 905, 340/907, 910, 466, 915, 539; 701/119

(56) References Cited

U.S. PATENT DOCUMENTS 4,591,823 A * 5/1986 Horvat ..... 340/910
5,289,183 A * 2/1994 Hassett et al. ..... 340/905
5,381,155 A * 1/1995 Gerber ..... 340/936
5,952,941 A * 9/1999 Mardirossian ..... 340/936

* cited by examiner

*Primary Examiner*—Anh La
(74) *Attorney, Agent, or Firm*—Dougherty & Troxell

(57) ABSTRACT

A traffic speed control and surveillance system includes a speed sensor, vehicle identifier and transmitter/receiver disposed in a motor vehicle. The system also includes a plurality of mini remote terminal units disposed along a highway for monitoring signals from passing motor vehicles. Those signals identify the vehicle and speeds of those vehicles. The system also includes a communication center and one or more master remote terminal units for linking the mini remote terminal units to the communication center which processes the information. The communication center may also transmit a signal to disable the engine of an offending vehicle.

7 Claims, 5 Drawing Sheets

TRAFFIC SPEED SURVEILLANCE AND CONTROL SYSTEM

FIELD OF THE INVENTION

This invention relates to a traffic speed and control system for motor vehicles and more particularly to an improved traffic speed and control system that records and reports speed limit violations and alerts patrol cars of vehicles being driven at an excessive rate of speed and their location.

BACKGROUND FOR THE INVENTION

Traffic surveillance and control systems for motor vehicles are well known. For example, U.S. Pat. No. 3,680,043 of Angeloni discloses a system for monitoring the speed of highway vehicles from a central control station. The system includes posting devices positioned at intervals along the highway and adapted to receive a speed message from the control station and transmit the speed message to passing vehicles in a limited region of the highway in the form of an r-f signal. Each vehicle contains an r-f receiver which is connected to the vehicle speedometer or other vehicle identification means in a manner that will provide, upon the occurrence of some predetermined excessive speed, an indication to the driver of the vehicle that the speed limit at that particular region of the highway is being exceeded. There is also a provision for reporting back to the control station the occurrence of an excessive vehicular speed as well as for providing accident warnings and the like.

A more recent approach to traffic speed surveillance systems is disclosed in U.S. Pat. No. 4,591,823 of Horvat. As disclosed therein, the system includes a set of monitored transceivers located along a roadway and communicating with a central processor. The system also includes stationary transceivers for sending radio signals indicative of the speed limit in the location of a particular stationary transceiver. A vehicle transceiver mounted in a vehicle includes means for entering driver identification, vehicle identification and speedometer means for measuring the speed of the vehicle. The vehicle transceiver receives the radio signals from the monitored transceiver indicative of speed limit and compares measured speed against the limit and sends radio signals indicative of drive identification, vehicle identification and speed limit violation to the monitored transceiver for reporting to the central processor.

A further and even more recent approach to traffic surveillance systems is disclosed in U.S. Pat. No. 5,952,941 of Mardirossian. As disclosed therein, a satellite traffic control system determines the location, and upon which roadway a vehicle is traveling. A memory in the vehicle system stores speed limit data relating to different roads, speed limits and/or red lights across the globe. A controller in the vehicle compares speed limit data, relative to determined speed of the vehicle so as to detect when the speed limit on the road upon which the vehicle is traveling is exceeded. When the speed limit is exceeded, a transmitter on the vehicle transmits a signal to at least one satellite indicative of the violation. The satellite forwards the violation signal to a motor vehicle department so that a ticket can be issued to the vehicle operator. In a similar manner, the satellite base system can detect other infractions such as running of red lights, and issue tickets in response to the same.

The traffic surveillance systems described above have not received broad commercial success. Accordingly, it is presently believed that there may be a need for an improved traffic surveillance system in accordance with the present invention. It is also believed that there may be a commercial market for an improved traffic surveillance system which offers numerous advantages. For example, it is presently believed that the implementation of the system disclosed herein will save lives, reduce injuries and property damage due to traffic accidents. As a result, there should be a corresponding reduction in hospital expenses and insurance claims which should further reduce the cost of accident and health insurance.

The system disclosed herein should also reduce aggressive driving techniques and aid in accident investigations. In addition, the systems will improve road safety for drivers and pedestrians, and should reduce the cost of enforcing speed limits and allow patrol vehicles and officers to concentrate on more serious offenses and/or provide assistance to drivers and others in need of help. Further, the systems disclosed herein should generate more revenue by an automated ticket function. The system also provides a remote system for disabling a vehicle which is being operated at a speed in excess of a given rate or in the case of an emergency to disable all vehicles in a given area with the exception of emergency vehicles.

BRIEF SUMMARY OF THE INVENTION

In essence, the present invention contemplates an improved traffic speed surveillance and control system for regulating the speed of motor vehicles in selected areas. The traffic speed surveillance and control system includes a speed sensing means and vehicle identification means, both disposed within a motor vehicle as well as a vehicle mounted transmitter/receiver means which is operatively connected to the speed sensing means. The vehicle mounted transmitter/receiver means, transmits radio signals which are indicative of the vehicle identification and speed in a given location.

A plurality of speed monitoring mini remote terminal units are located along a highway. Each of those units includes location identification means and a first remote transmitter/receiver means for receiving signals from a vehicle mounted transmitter/receiver means which is indicative of the speed and identification of a passing vehicle. Each of the speed monitoring mini remote terminal units include computer means, a programable speed limit programmed into the computer, location identifying means and means for comparing the speed limit and the speed of a passing vehicle.

The traffic speed surveillance and control system also includes a communication center and one or more master remote terminal units receiving signals from a plurality of speed monitoring mini remote terminal units. The remote terminal units transmit data indicative of vehicle speed in excess of speed limits, vehicle identification and location from the mini remote terminal units to the communication center.

The communication center includes means for processing the information from the master remote terminal unit as for example to print a traffic citation for forwarding to the vehicle owner or to a patrol car for stopping the vehicle. Also, when the speed exceeds a predetermined speed over the speed limit, the communication center can transmit a signal to disable the engine in the offending vehicles or in the event of an emergency, to disable all of the motor vehicle engines in the area other than emergency vehicles wherein the vehicles include means to override the engine disabling function.

Each of the plurality of mini remote terminal units also includes means for generating a signal indicative of vehicle passing speed and identification when the vehicle speed exceeds the programmed speed limit.

The invention will now be described in connection with the accompanying drawings wherein like reference numerals have been used to identify like parts.

DESCRIPTION OF THE PREFERRED EMBODIMENTS OF THE INVENTION

Figure 1:
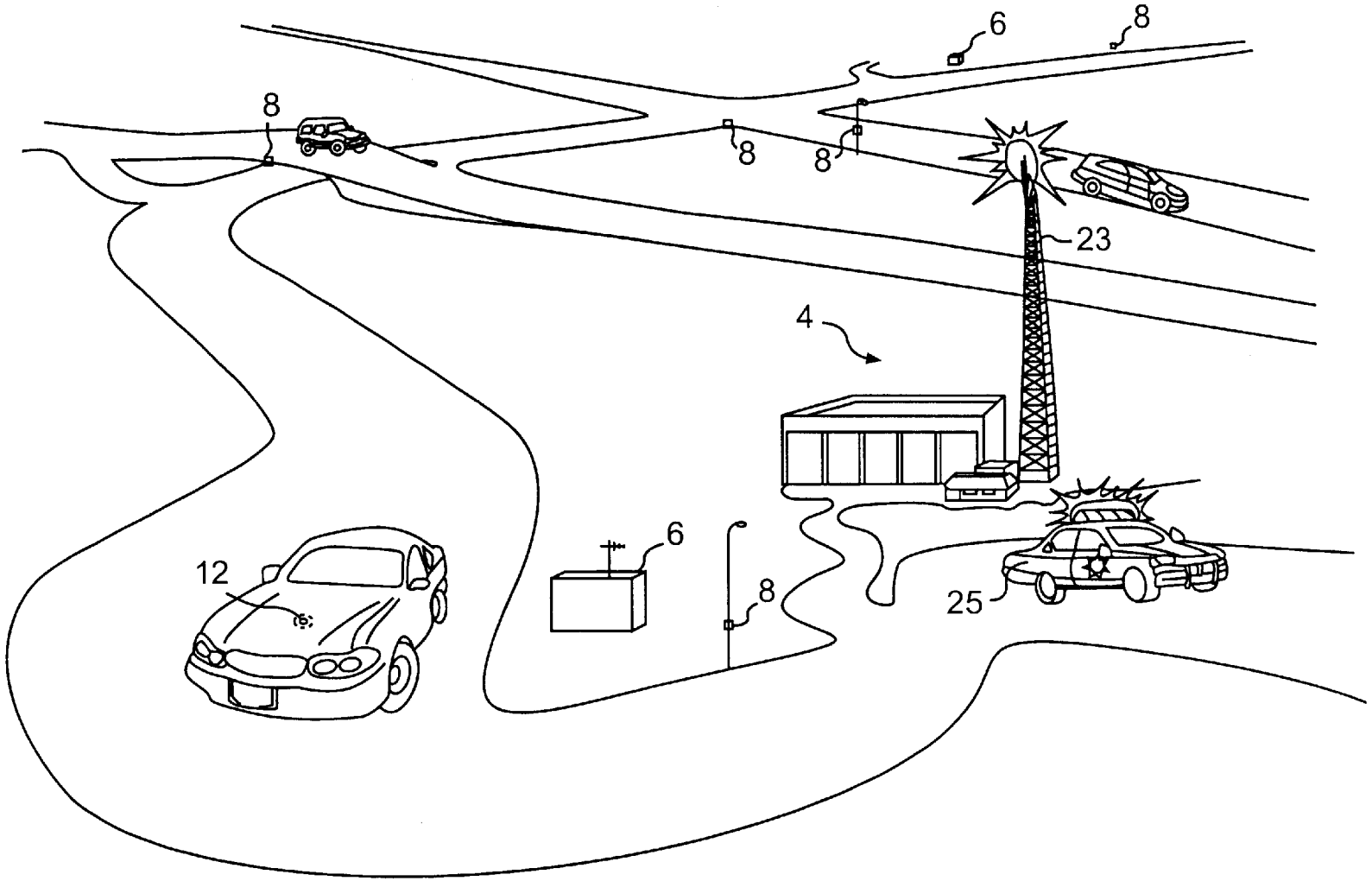
FIG. 1 is a schematic illustration of a traffic surveillance and control system in accordance with a first embodiment of the invention.
Figure 2:
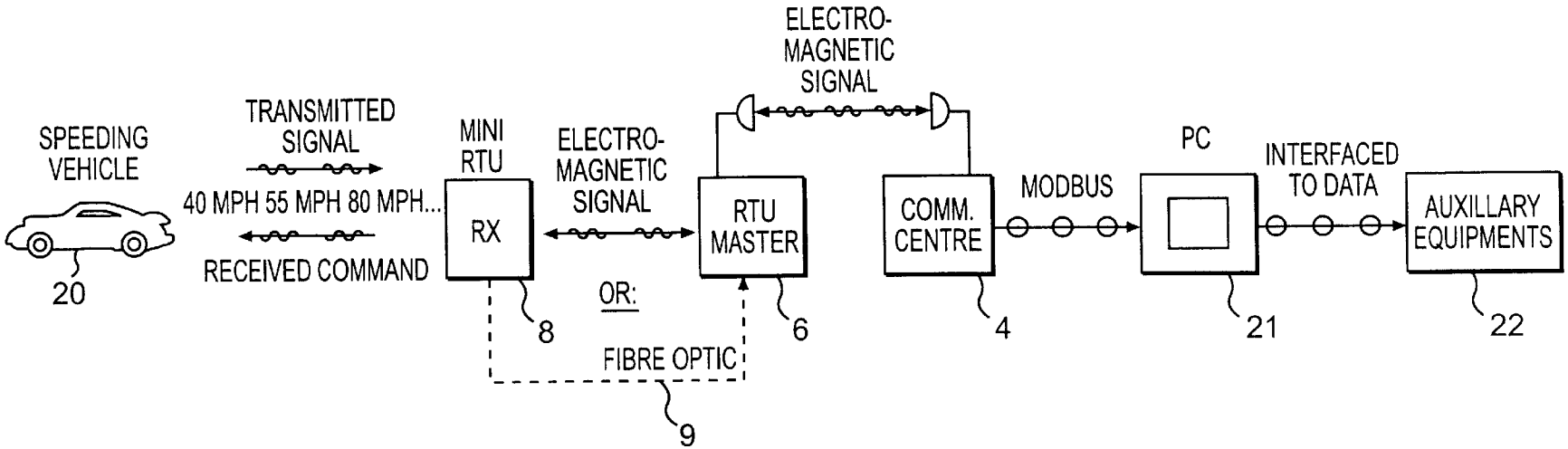
FIG. 2 is a schematic diagram of a traffic surveillance and control system shown in FIG. 1.

As shown in FIGS. 1 and 2, a traffic speed surveillance and control system according to the present invention includes a master communication center 4 and a plurality of master remote terminal units 6 for transmitting signals from the master remote terminal unit 6 to the master communication center 4. In a preferred embodiment of the invention, the master remote terminal units 6 includes means for the wireless transmission of signals to the center 4. For example, any conventional wireless transmission device may be incorporated in the system.

The traffic speed surveillance and control system also includes a plurality of detectors or mini remote terminal units 8. These mini remote terminal units 8 are disposed along a highway and adapted to receive signals from a passing vehicle. Such signals provide a vehicle identification number, driver's identification number and speed of the passing vehicle are transmitted. The mini remote terminals may be disposed on light posts, bridge abutments, in the roadway as for example a cat's eye reflector or other location. In some areas it may be preferred to place the detectors unobtrusively while in others the units 8 are displayed in a manner which is clearly visible to the driver as a warning, particularly in areas of school zones or the like.

The mini terminals 8 should be of compact design, of sturdy construction, capable of use in all weather conditions, programmable via an infrared port or fiber optic cable link and having sufficient data memory to process signals from many cars passing in a very short period of time.

Each of the mini remote terminal units 8 are connected to one of the master remote terminal units 6 as for example by a wire, fiber optic cable 9 or the like. The mini remote terminal units detect a vehicle identification number and/or driver's identification and speed of the passing vehicle and transmits that information together with the location of the mini remote unit or detector to the master remote terminal unit 6 for transmission to the master control center 4.

In a preferred embodiment of the invention, each of the mini remote terminal units 8 include programmable means for inputting a speed limit for the area covered or policed by that remote terminal unit 8. The mini remote terminal unit 8 also includes comparison means or the like so that if a vehicle is operated within the speed limit, no signal will be generated or transmitted to the maxi remote terminal unit 6.

Each motor vehicle includes a communication device 12 which is operatively connected to speed sensing means. The communication device 12 also includes vehicle identification means as well as a transmitter/receiver (transceiver) which is operatively connected to the speed sensing device. The transceiver is adapted to transmit and receive signals to and from the mini remote terminal units 8 which are located along a highway.

In one embodiment of the invention, the communication device may transmit signals indicative of the vehicle speed in 5 mile per hour or other increments while the mini remote terminal units 8 may be programmed to ignore signals which are less than 5 miles per hour over the posted limit.

The communication device 12 is preferably disposed in a sealed package and embedded inside the vehicle programmable microprocessor base unit and is provided with a back-up battery. The communication device 12 preferably communicates with the mini remote units 8 via a VH band and may be an integral part of or connected to the vehicles computer board. A programmable connection port is also provided so that warnings in a dashboard display or audio signal may be given when a posted speed limit is exceeded. The system may also be programmed to transmit different signals at different speeds.

As illustrated in FIG. 2, a speeding vehicle 20 includes a communication device 12 (FIG. 1) which transmits a vehicle identification number and speed to a mini remote terminal 8. The mini remote terminal 8 transmits a signal by fiber optic cable 9 or a wireless signal to the master remote terminal unit 6. That signal identifies a vehicle and/or driver and the vehicle speed over the posted limit. The master remote terminal unit transmits the information received to the master communication center 4.

The master communication center 4 processes the signal by means of a computer 21 which compares the speed with the location and directs auxiliary equipment 22 to issue a citation to the offending vehicle and/or driver.

The remote communication center may also broadcast a signal as for example by a tower 23 (FIG. 1) to alert a patrol car 25 of a serious situation and its location.

Figure 3:
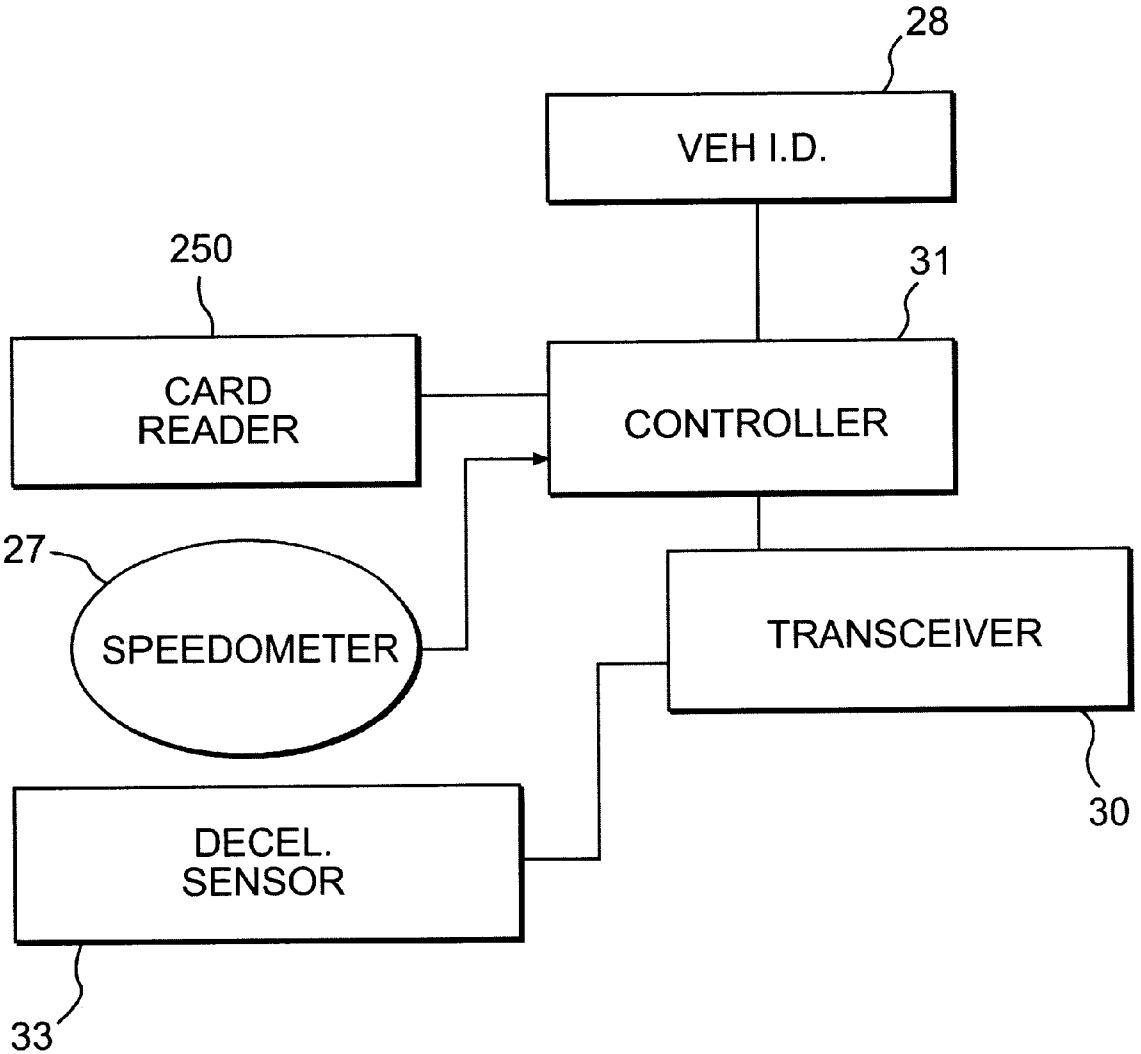
FIG. 3 is a block diagram of a vehicle communication device for use in a traffic surveillance and control system according to the invention.

Referring to FIG. 3, each vehicle includes a card reader 250 or any other suitable input device for inputting data as for example driver's license number, social security number or the like. Furthermore, the vehicle identification number 28 such as the license plate number is entered into a controller 31 in each vehicle. This controller 31 is programmed to disable the engine until the aforementioned information is inputted into the controller 31. In this manner, the controller 31 will indicate the vehicle identification and driver in the event that the vehicle is detected at a speed in excess of the posted limit.

Speedometer 27 monitors and continually outputs the speed of the vehicle while the transmitter/receiver 30 is provided for receiving communications from mini remote terminal units 8 with respect to the speed limit in the area of the vehicles operation.

The vehicles communication device illustrated in FIG. 3 is incorporated in a sealed tamper-proof package within a motor vehicle. It is basically a programmable microprocessor unit provided with a back-up battery and is capable of transmitting and receiving signals as for example via a VHF band. The device may also be an integral part or connected to the vehicles computer board.

Deceleration sensor 33 senses a sudden deceleration of the vehicle as caused by an accident or airbag deployment and sends a signal to the transmitter/receiver 30 which transmits a signal to the nearest mini remote terminal unit 8 (FIG. 1). The mini remote terminal unit 8 relays a signal indicative of an accident to the communications center 4 (FIGS. 1 and 2) by means of the master remote terminal unit 6. The communication center 4 then broadcasts a signal to a patrol car 25 indicating the location and reporting an accident.

Figure 4:
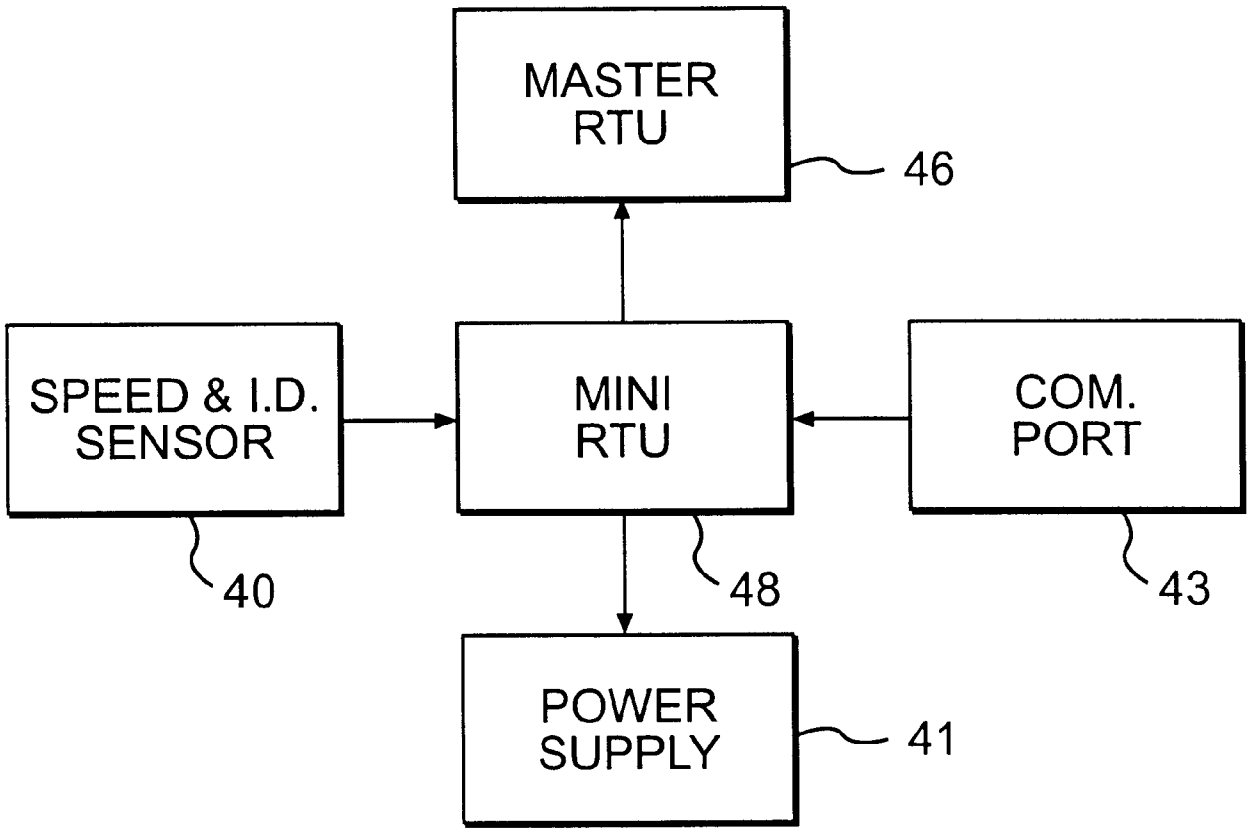
FIG. 4 is a block diagram of a mini remote terminal unit and its communication links to a master remote terminal unit in a traffic surveillance and control system according to the invention; and, FIG. 5 is a block diagram of a computer and other components located at a central communications facility.

As illustrated in FIG. 4, a mini remote terminal unit 48 includes a speed and ID sensor 40 for monitoring the speed and identification of passing vehicles. The remote terminal unit 48 includes sufficient memory to monitor many vehicles and to maintain the information in memory for a preselected period of time. In this manner, a speeding car's speed could be traced back in the event of an accident.

The mini remote terminal unit 48 also includes a conventional power supply 41 and a communication port 43. The unit 48 can then be programmed as for example to change the speed limit or to screen out signals that are less than a preselected value over a posted speed limit from a remote location.

Figure 5:
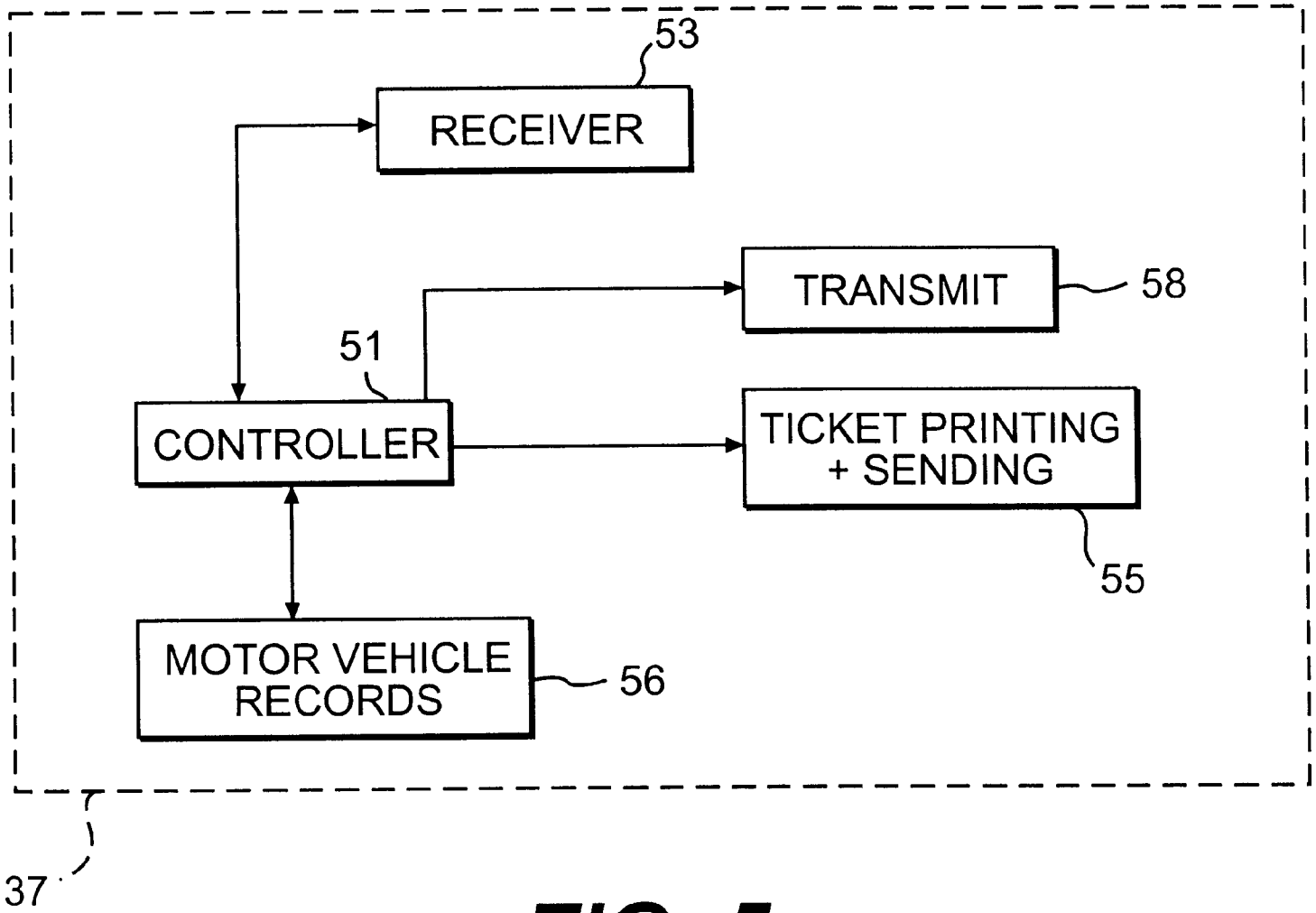

FIG. 5 illustrates the components of the master communication center or central communication facility 37. As shown therein, the facility 37 includes a receiver 53 for receiving signals from a master remote terminal unit and feeding those signals into a computer or controller 51. The controller 51 is linked to a ticket printer 55 which may include automatic mailing as well as the motor vehicle records 56 for recording the offense. The controller 51 is also connected to a transmitter 58 and may be programmed to automatically notify a patrol car of any transgression that exceeds a speed limit by a preselected amount or percentage in order to stop those vehicles which are traveling at a dangerous rate of speed.

While the invention has been described in connection with its preferred embodiment, it should be recognized and understood that changes and modifications may be made therein without departing from the scope of the following claims.

What is claimed is:

1. A traffic speed surveillance and control system comprising:

speed sensing means and vehicle identification means disposed within a motor vehicle and a vehicle mounted transmitter/receiver means operatively connected to said speed sensing means for transmitting radio signals indicative of the vehicle speed and identification;

a plurality of speed monitoring remote terminal units located along a highway, each of said remote terminal units including location identifying means and first remote transmitter/receiver means for receiving signals from the vehicle mounted transmitter/receiver means indicative of the speed and identification of a passing vehicle, and each of said remote terminal units including computer means, a programmable speed limit programmed into said computer means, the location identifying means and means for comparing the speed limit and the speed of the passing vehicle and means for generating a signal indicative of the vehicle's passing speed and identification when the vehicle speed exceeds the programmed speed limit;

a communication center;

a master remote terminal unit for receiving signals from the plurality of speed monitoring remote terminal units and for transmitting data indicative of the vehicle speed in excess of speed limits, vehicle identification and location to said communication center; and said communication center including means for processing the information including the data from said master remote terminal unit.

2. A traffic speed surveillance and control system according to claim 1 in which said means for processing the information from said master remote terminal unit includes means for transmitting a warning signal to the identified vehicle of its excessive speed.

3. A traffic speed surveillance and control system according to claim 1 in which said means for processing the information from said master remote terminal unit includes means for transmitting vehicle speeds and identification to patrol cars.

4. A traffic speed surveillance and control system according to claim 1 in which said means for processing the information from said master remote terminal unit includes means for printing citations to be sent to an owner/driver of an identified speeding vehicle.

5. A traffic speed surveillance and control system according to claim 1 which includes engine disabling means responsive to a signal from said communication center when the speed of the vehicle exceeds the speed limit by a predetermined amount.

6. A traffic speed surveillance and control system according to claim 1 which includes one enable means which is activated by inputting a driver's identification.

7. A traffic speed surveillance and control system according to claim 5 in which said communications center includes means for disabling all the motor vehicle engines in a given area except for emergency vehicles.

* * * * *